US009186010B2

(12) United States Patent
Carbray

(10) Patent No.: US 9,186,010 B2
(45) Date of Patent: Nov. 17, 2015

(54) DEVICE TO ASSIST IN PUTTING ON AND TAKING OFF CLOTHING

(76) Inventor: William Carbray, Newstead (AU)

( * ) Notice: Subject to any disclaimer, the term of this patent is extended or adjusted under 35 U.S.C. 154(b) by 0 days.

(21) Appl. No.: 13/824,951

(22) PCT Filed: Sep. 21, 2011

(86) PCT No.: PCT/AU2011/001208

§ 371 (c)(1),
(2), (4) Date: Mar. 18, 2013

(87) PCT Pub. No.: WO2012/040770

PCT Pub. Date: Apr. 5, 2012

(65) Prior Publication Data

US 2013/0214016 A1 Aug. 22, 2013

(30) Foreign Application Priority Data

Oct. 1, 2010 (AU) ..... 2010904420

(51) Int. Cl.
*A47G 25/80* (2006.01)
*A47G 25/90* (2006.01)

(52) U.S. Cl.
CPC ..... *A47G 25/90* (2013.01)

(58) Field of Classification Search
CPC ... A47G 25/90; A47G 25/905; A47G 25/907; A47G 25/908
USPC ..... 223/111–113
See application file for complete search history.

(56) References Cited

U.S. PATENT DOCUMENTS 892,162 A * 6/1908 Kennedy ..... 294/22
1,116,797 A * 11/1914 Carmichael et al. ..... 223/113
3,727,812 A * 4/1973 Weiss ..... 223/111
3,883,052 A * 5/1975 Wilson ..... 223/111
4,638,932 A * 1/1987 Keller ..... 223/111
4,756,453 A * 7/1988 Pettit et al. ..... 223/111
5,626,269 A * 5/1997 Duarte ..... 223/112
5,636,774 A 6/1997 Moscato
5,706,988 A * 1/1998 Moore ..... 223/111
5,769,289 A 6/1998 Lusk
6,276,578 B1 * 8/2001 Stenger ..... 223/112
2004/0060950 A1 * 4/2004 Goff et al. ..... 223/112
2005/0205619 A1 9/2005 Morel
2008/0277432 A1 * 11/2008 Horcher ..... 223/112
2009/0039118 A1 2/2009 Whitelaw
2010/0006609 A1 * 1/2010 McAllister et al. ..... 223/111
2010/0078450 A1 4/2010 Longhurst
2010/0193554 A1 8/2010 Atkinson
2010/0258600 A1 10/2010 Pfistor
2011/0101046 A1 * 5/2011 Moscato ..... 223/112

FOREIGN PATENT DOCUMENTS

CA 2641368 5/2009
FR 2921552 A1 * 4/2009 ..... A47G 25/90

* cited by examiner

*Primary Examiner* — Nathan Durham

(57) ABSTRACT

A device composed of a pair of 2 separate hand-held units (FIG. 1) designed to assist people with limited body flexibility due to age, accident, illness etc, to easily change their own underpants (18) or elastic waisted pants and trousers. It is particularly useful in changing disposable and washable incontinence underpants (18). Each unit is composed of a comfortable handle (1), a light but strong shaft (2) and a strong, lightweight curved head (3) attached to the opposite end of the shaft (2) to the handle (2). The convex surface of each head (3) is covered by a fabric gripping product (4) such as Velcro® hook or similar. Use involves attaching the inside of the garment's (18) waistband to the Velcro® surface (4) of the curved heads (3) so that when the units are held in an extended arm position the garment (18) is held comfortably open and in a position to allow such to be slipped easily over the user's feet (23) and raised to knee height.

19 Claims, 6 Drawing Sheets

DEVICE TO ASSIST IN PUTTING ON AND TAKING OFF CLOTHING

TECHNICAL FIELD

The present invention relates to a pair of similar but separate hand held units designed to assist people of limited body flexibility to dress, in particular to assist with the putting on and taking off of underpants both standard material and disposable incontinence types, as well as doing the same with tracksuit bottoms, plus elastic waisted trousers and slacks.

DESCRIPTION OF RELATED ART

People with diminished flexibility due to factors such as advancing age, back injury, hip replacement surgery, advanced pregnancy and other illnesses such as multiple sclerosis etc, can find it extremely difficult to put on and take off underpants and trousers, as often they can only reach to around their knees, even when seated.

The use of disposable incontinence underpants has grown greatly in recent times and this invention is particularly aimed at assisting with putting these items on and off. Incontinence pants are generally more difficult to put on and take off due to their tightly elasticised leg and waist openings. The inability to deal with these incontinence pants independently of external help is often a very distressing situation for the elderly with loss of any residual dignity and independence they may have, particularly when removing soiled garments.

Not to change soiled incontinence pants regularly as required can lead the user to a variety of skin and other associated health problems. Therefore the ability to do this easily by oneself is extremely important to the physical and emotional well being of users of such garments.

Any discussion of the prior art throughout this specification is not an admission that such prior art is widely known or forms part of the general knowledge of the field.

A number of earlier inventions have dealt with dressing problems, particularly aimed at socks and stockings, such as:
U.S. Pat. No. 5,636,774
U.S. Pat. No. 5,769,289
Canadian PAT 2641368, but none of these have addressed the problem of putting on and taking off trousers and underpants.

Various other patents, such as:
Pub No. US 2010/0078450 A1
Pub No. US 2010/0258600 A1
Pub No. US 2009/0039118 A1
AP No. US 2005/205619 A1
All deal with the problem of assisting people with limited flexibility to put on garments such as trousers. However, all of the above rely heavily on the use of clips, clamps and straps or include bulky frames. From the viewpoint of usage by particularly the elderly I believe none of these devices are simple enough in their function to allow the majority of elderly people to use them successfully without assistance.

A recent patent Pub No. US 2010/193554, titled, "Device to help with dressing", claims to assist with dressing, particularly pulling on trousers and incontinence pants.

This device consists of a base plate some 38 cm long by 28 cm wide, with 2 vertically fixed arms of 130 cm height. It is designed to allow the user to attach his or her pants to the upright arms and feed the pants on to such arms. The device then needs to be lowered to the floor by means of a strap, and then pulled into the correct position to allow the user to put their feet through the pants. I find it hard to understand how the majority of aged or flexibility challenged could possibly manage the above actions without assistance.

SUMMARY OF THE INVENTION

The object of the present invention is to provide a device to assist those with restricted flexibility to put on and take off their own underpants and elastic waisted trousers. It also aims to do this without clips or hooks or straps and be extremely lightweight and, if required, be easily portable in a bag or glove compartment of a vehicle. The present invention provides a device composed of two similar hand held units designed to assist people with limited body flexibility to simply put on and take off underpants or elastic waisted trousers, each unit consisting of a comfortable handle of various materials, connected to a strong, lightweight shaft, the shaft long enough so that when seated and holding the handle attached to the shaft, the other end of the shaft comfortably reaches the ground in front of the user's toes without excessive bending from the waist or hips, at the opposite end of each of the units' shafts, to the handle is firmly attached a strong, but lightweight, slim, narrow profile curved head whose external (convex) surface is covered with a fabric gripping material such as Velcro® hook, the heads designed to hold the weight of the garment comfortably and also hold the waistband of the garment open when correctly attached to the garment and the device is held in its correct working position.

DETAILED DESCRIPTION OF THE INVENTION

The present invention provides a device composed of a pair of similar hand held units to assist people with limited body flexibility due to age, accident, illness or pregnancy etc to simply and efficiently change their own underpants or elastic waisted trousers or slacks. It is particularly useful for changing disposable paper or other washable incontinence underpants.

Each of the above similar units is composed of a handle designed to allows safe, comfortable grip of the unit. This handle is attached to one end of a strong, but lightweight, shaft designed to extend the user's reach so as to be able to comfortably reach their feet and so place their pants over their feet. At the opposite end of the shaft to the handle is a strong, but lightweight, curved head with a Velcro® hook or other similar fabric gripping material firmly affixed to cover the entire outside (convex) surface of each of head.

The units are designed to be held uniquely in either the right or left hand and are so marked with the letters R & L.

The Velcro® covered surface of the curved head is designed to securely attach to the inside of the garment's waistband. When correctly attached, these heads in their operating position are designed to effectively hold the garment waistband open to allow easy access to the garment by the user's feet. The device is designed to be operated with the user in a seated position on a standard height chair or a standard toilet seat.

Each head is also located on its respective shaft at a set angle to the shaft. Each head is set at the same angle. This angle is designed to ensure that in its working position each head holds open the waist of the garment at the best angle to allow easy egress by the user's feet into the waist opening.

Each head also has 2 unique angled corners on the edge closest to the user to allow it to wedge under the waistband of articles of clothing heavier than underpants, such as tracksuits etc. This feature is to assist the Velcro® to support the weight of the said article when lifting it to knee level.

Each device may be of a single-piece, integrated construction with handle shaft and head integrally moulded as one unit in a process such as injection moulding using material such as polycarbonate plastic or other suitable injection mouldable plastic or aluminium etc. The Velcro® type material would then be secured to the convex surface of each head by means of a suitable adhesive.

Each unit may also be produced as 3 separate parts. The shaft may be produced preferably in a more lightweight, but strong material such as GRP (Glass Reinforced Plastic) in a tubular form either parallel or tapered longitudinally.

The material used could contain other fibres such as graphite or Kevlar® for added strength. The shaft may also be produced in similar tubular or semi-tubular form from aluminium or one of its alloys. The shaft must have lightness but sufficient tensile strength to accomplish its purpose.

After construction of the shaft as above, it may be attached to a plastic or aluminium head similar in construction and profile to that used in the integrally moulded unit. This head would have, as part of its profile, a moulded mounting block into which a hole would be formed (moulded or drilled) at the same set angle as discussed earlier, and the shaft would be securely fixed to the head by inserting it into this mounting hole and securing it with a suitable epoxy resin. The mounting hole would penetrate about 75% of the way through the mounting block on the head.

All formed from lightweight, but soft, material such as EVA (Ethylene Vinyl Acetate) or similar closed cell foam, may be formed in a cylindrical or oval form with a central longitudinal hole in one end and extending around 90% of the length of the handle, this hole is similar in diameter to the diameter of the shaft and the two pieces firmly secured with a suitable epoxy resin. In its completed form each lightweight device should ideally weigh 50 gms or less.

It is also very desirable to have as an option in the above construction method of 3 separate units, a telescopic shaft. This allows for the device to be easily stored but more importantly to be very portable. Today, many people with flexibility restrictions still carry on a very mobile lifestyle and it is vitally important to be able to deal with changing of pants wherever their daily agenda takes them.

The telescopic unit would ideally only be around 150 mm long in its compressed state. And around 500 mm when fully extended.

The joints in the telescopic form of the shaft must be engineered in such a fashion as to allow the unit to be easily extended with minimum effort, but also easily collapsed by simply holding the handle in one hand and gently tapping the head towards the handle with the other hand. No twisting motion must be necessary to either extend or collapse the telescopic unit.

the telescopic units should, when finished, be no more than 50 gms each in total weight. It is envisaged that when packaged for travelling in a soft vinyl carry case or other lightweight suitable container with easy opening, Velcro® or similar fastening, the two telescopic units, plus a spare pair of incontinence or standard pants, along with the travelling container, should weigh no more than 200 gms in total. The travel container should be no larger than 180 mm×120 mm×40 mm, enabling it to be easily transported in a handbag or vehicle glovebox.

BRIEF DESCRIPTION OF DRAWINGS

By way of example only, 3 preferred embodiments of the present invention is described in detail with reference to the accompanying drawings, where.

BEST MODE FOR CARRYING OUT THE INVENTION

Figure 1:
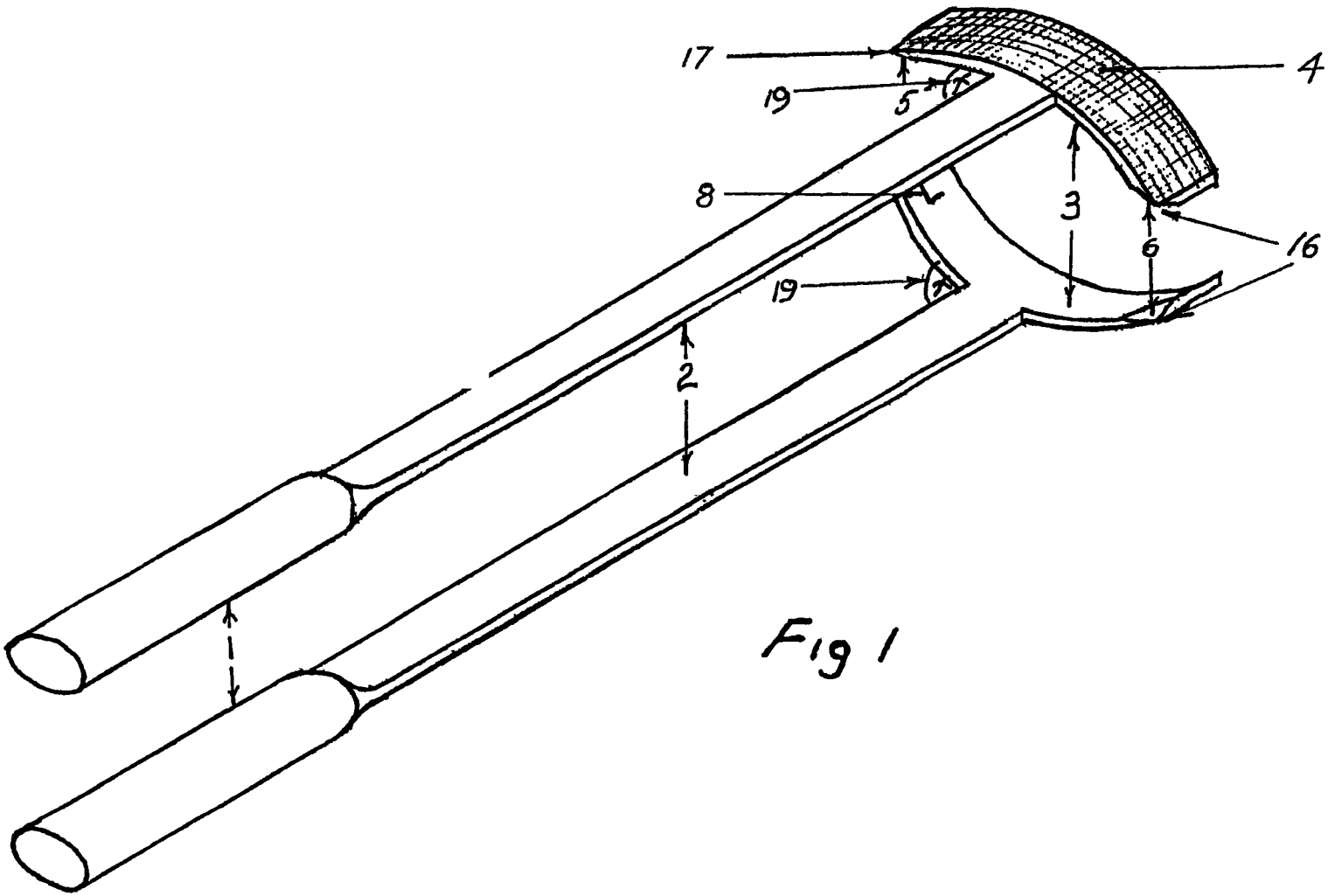
FIG. 1 is an isometric view of the integrally produced device showing both the left and right hand units.

Referring to the drawings (Fig—FIG. 4) each device consists of 2 similar units each made up of a handle (1, 10), shaft (2, 11, 15) and head (3, 12). The 2 units are uniquely for right or left hand use and are so marked R & L (7, 8). Each head (3, 12) has its external (convex) surface covered with a Velcro® type material (4) and the two corners of each head closest to the hand (1, 10) have on their concave surface a tapered, triangular area of approximately 10 mm×7 mm×7 mm (5, 6) reducing the corner thickness to approx 1 mm (16, 17).

The most economical form of the device (FIG. 1) is composed of the above mentioned handle (1), shaft (2) and head (3), all being formed as an integral unit by a moulding process using material such as polycarbonate plastic or similar, or even lightweight metal such as aluminium or one of its alloys.

The cross section of the handle (1) must be such as to offer a comfortable secure grip. The cross section of the shaft (2) will vary according to the material but must have sufficient tensile strength to fulfil its role of supporting the weight of the garment being put on and also holding the waist opening of the garment (18) in the open position when the device is fully extended.

The head (3) is in the form of an elongated rectangle of a width suitable to comfortably fit with the waistband of underpants and when bent into a shape approximating a quadrant of a circle, is long enough to hold the waistband of the garment sufficiently open to allow the user's feet to slide comfortably into the opening of the waistband of the pants. The thickness of the head (3) will vary according to the material used but must have sufficient tensile strength and rigidity to fulfil its role of supporting the garment being put on in an open position when the device is extended and also comfortably support the weight of the garment (18) when attached to the head (3) via the Velcro® (4) material with the device fully extended. The head (3) may be of a variety of shapes, provided it fulfils its functional role successfully.

each head (3) will also have on the two corners of its profile closest to the handle, tapered corners (5, 6) in a triangular form of approx 10 mm×7 mm×7 mm which are angled to reduce each corners' thickness to approx 1 mm (16, 17).

These tapered corners (5, 6) are to allow the head to slip under the waistband of heavier garments such as tracksuit pants to assist the Velcro® (4) to support the garment's weight when being manipulated by the user.

The external (convex) surface of each head (3) has a covering of Velcro® hook (4) or similar fabric gripping material to allow the garment (18) being put on to firmly adhere to the convex surface of the head (3).

Figure 2:
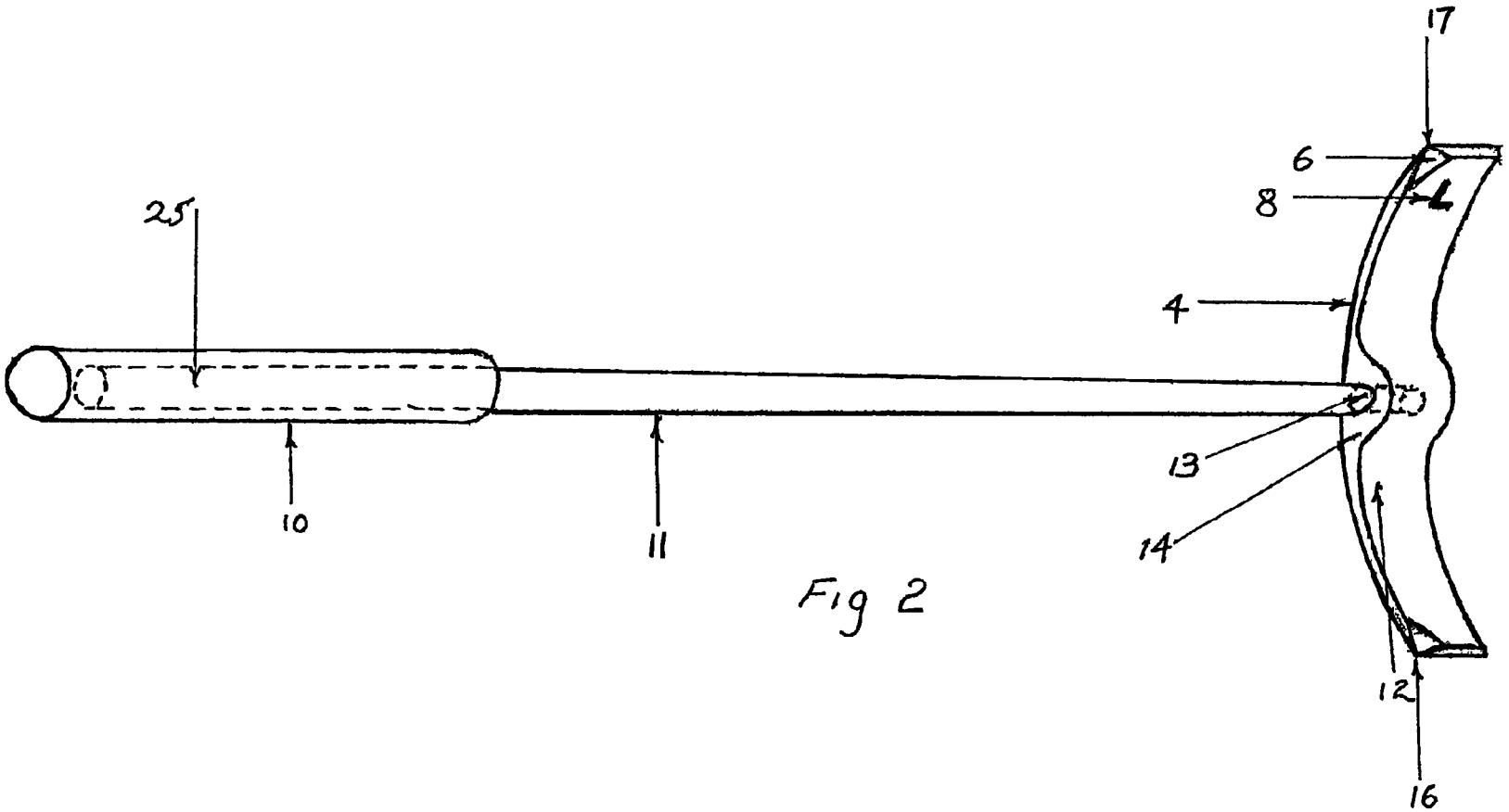
FIG. 2 is an oblique view of the left hand unit of the separately produced device with fixed length lightweight shaft.

In FIG. 2 we see a depiction of a slimmer lightweight version of the device. Here the handle (10), shaft (11) and head (12) are produced separately of varying suitable materials.

The shaft (11) as shown in FIG. 2, may be made from GRP (Glass Reinforced Plastic) with additional strengthening materials such as graphite fibres or Kevlar® fibres added to increase tensile strength if required. Alternatively aluminium or one of its alloys may be used. Ideally the shaft (11) cross section will be of a hollow circle or oblong where wall thickness and external diameter is kept to a minimum to reduce weight while not compromising the necessary tensile strength to fulfil its role in the device of supporting the garment being held at the full extension of the device, while securely holding the waist opening of the garment being used in the open position.

The longitudinal profile of the above described handle may be parallel or tapered.

The handle (10) of the above unit should ideally be formed from a soft, but lightweight, waterproof material such as EVA closed cell foam or other suitable material such as cork etc. The handle's profile should be such as to allow a comfortable grip for the user and have a central hole (25) running along its long axis for approx 90% of its length. This hole would approximate in diameter, the handle end diameter of the independently produced shaft (11) as described above such handle (10) would be firmly affixed to the said shaft (11) by sliding shaft (11) fully into handle hole (25) and securing with a suitable waterproof adhesive.

The independently produced head (12) would be produced from similar materials as the integrally produced head (3) and its external curved (convex) shape would be similar, as would its basic dimensions of length and width. Likewise the tapered corners (5, 6) would also be present as in the integrally produced head (3). The external (convex) surface would also be covered in the same Velcro® (4) hook or similar material as in the integrally produced head (3). The heads (12) would also be uniquely left and right hand and be so marked R & L (7, 8).

The independently produced head (12) would differ from the integrally produced head (3) mainly in its internal concave face, where a mounting block (14) would be integrally moulded onto this form of head (12).

This mounting block would have centrally located a mounting hole (13) of a diameter only slightly less than the diameter of the head end of the separately produced shaft (11). This hole would be parallel to the short axis of the head and at an angle (19) to the long axis of the head (12). This hole (13) may be integrally moulded with the head (12) or drilled after manufacture to a depth of approx 75% of the length of the head's (12) short axis.

This form of the device with independently manufactured handle (10), shaft (11) and head (12) should be more lightweight and comfortable to use than the integrally formed unit (FIG. 2) but would be more expensive to produce.

Figures 3, 4:
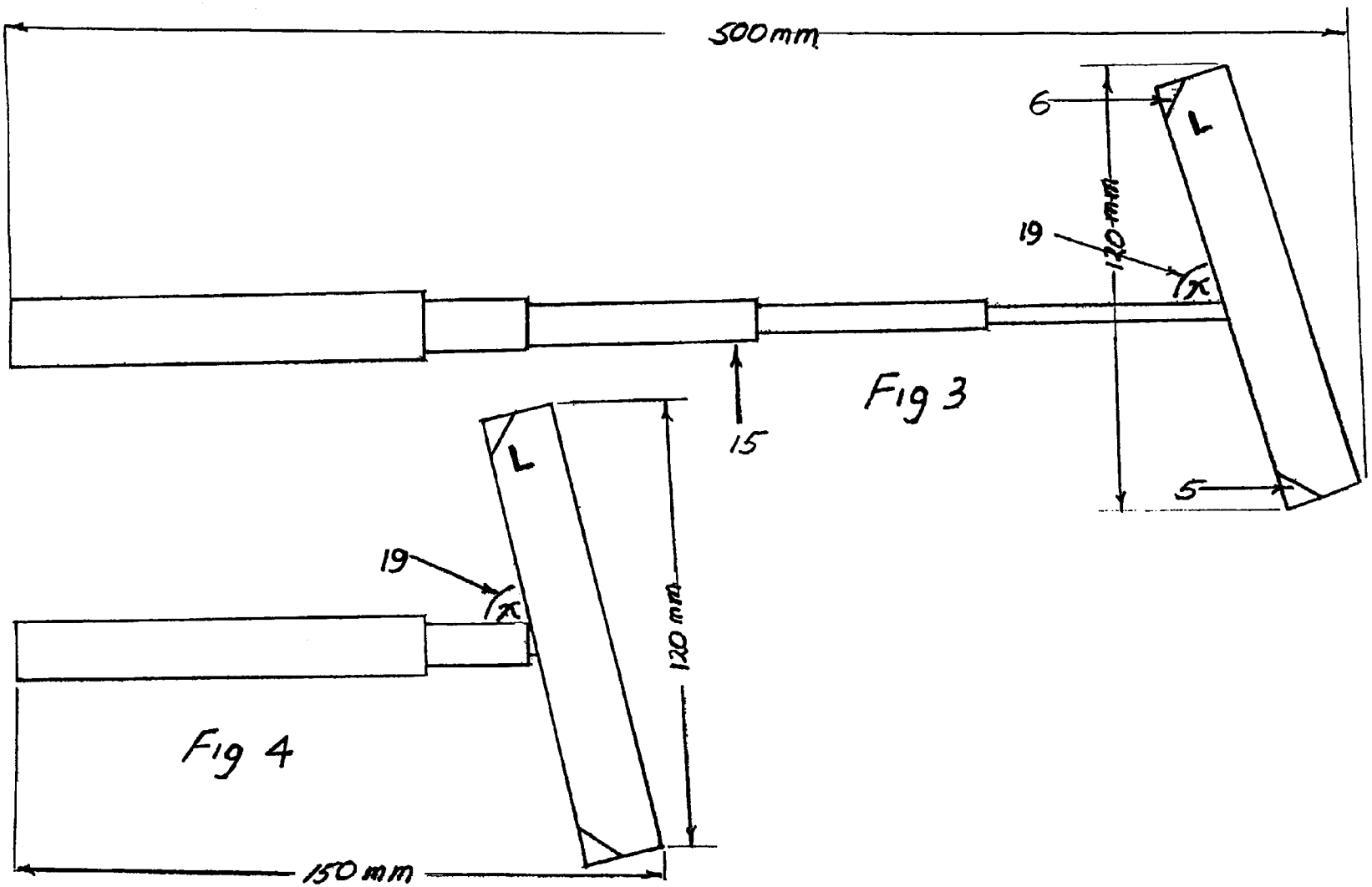
FIG. 3 a side elevation of the left hand version of the lightweight telescopic unit in its fully opened position.
FIG. 4 a side elevation of the left hand unit of the lightweight telescopic device in compressed position.
Figure 5:
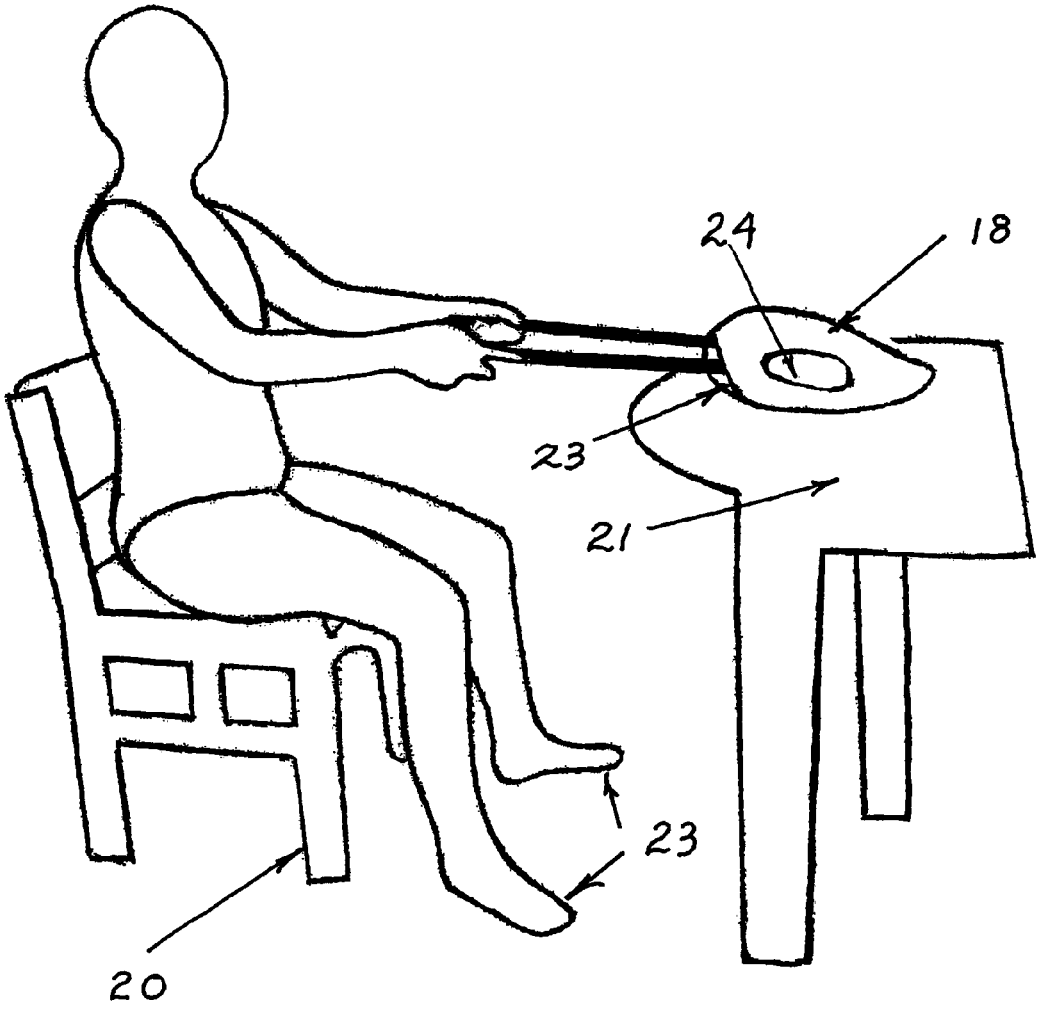
FIGS. 5-7 artist representations of device being used.
Figure 6:
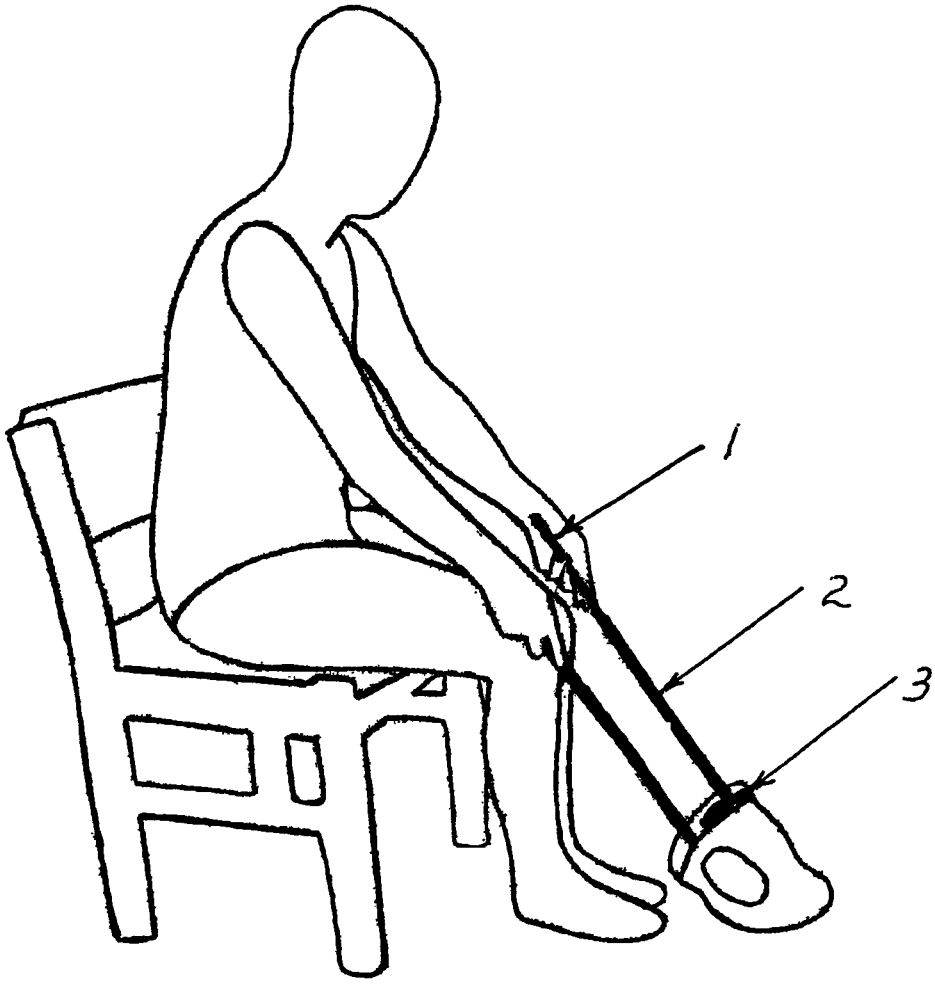
Figure 7:
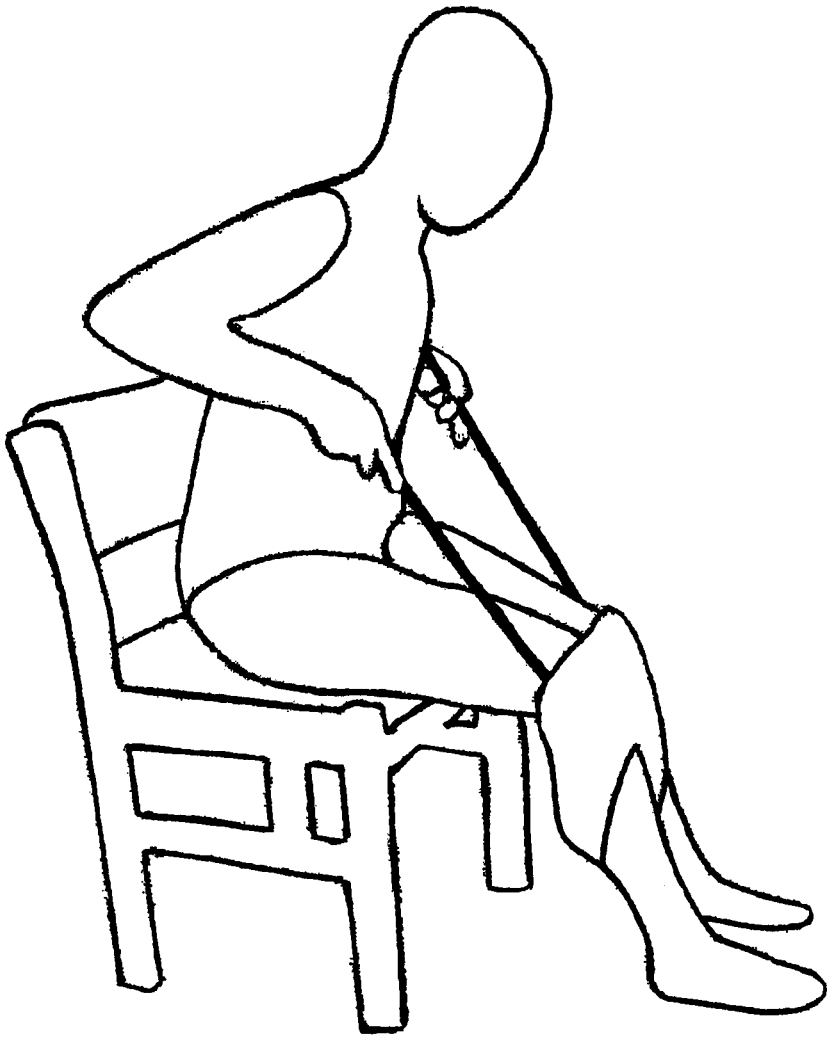

The third form of the device would be as shown in FIG. 3, for the shaft (15) to be produced of similar materials of similar shape and dimensions and of similar strength to the previously described lightweight shaft (11), but would differ in that it would be telescopic in nature, composed of sufficient telescoping pieces so as to reduce length to approx 150 mm when contracted.

this would give this version of the device (FIG. 3) the added benefits of compact packaging and simple portability.

The final construction of this version would involve fitting the same head (12) and handle (10) and Velcro® material (4) as fitted to the previously described lightweight shaft (11) to telescopic shaft (15).

The overall dimensions of the units may vary slightly with an overall length of around 500 mm seeming to be close to ideal. In the case of hip replacement patients and some Multiple Sclerosis sufferers it might be desirable to increase the overall length. The ideal overall length of each head (3, 12) type seems to be around 120 mm in a straight line from narrow edge to narrow edge. The width of the heads (3, 12) seem to work best at around 20 mm but for heavier garments or materials where grip of Velcro® is reduced 25 mm may be needed.

The above described devices are best used in the following manner:

Step One is for the user to sit on a comfortable, upright chair (20) before a standard height table (21) with the devices (FIGS. 1, 2, 3) of their choice and the garment (18) to be put on, all placed on the table (21) in front of them.

The left hand device marked L (7) is then placed with its head (3, 12) inside the left hand side waist band on the garment (18) and by gently stretching the waistband allow the Velcro® surface (4) of the head (3, 12) to grip the waistband firmly. This process is then repeated with the right hand device (8) on the right side of the garment (18) waistband. At this time, the front section of the garment (18) should be uppermost on the table (21) and the left and right designation marks (7, 8) on heads (3, 12) also should be uppermost. The garment (18) is then ready to be easily put on by the user simply picking up the two units by the handles (1, 10) and extending both units towards their feet (22) with the heads (3, 12) held gently apart to keep pants open. When the garment (18) is then placed in front of the user's feet (22) it is automatically in a comfortable position and format for the user to conveniently slide one foot at a time through the waist opening (23) and exit the relevant leg opening (24) so that both feet are on the floor and the unit (18) is around the user's ankles. While still in the seated position, the user then gently raises the device by bending from the elbow and allowing the garment (18) to slide easily up their lower legs and reach knee level. At this time the units are gently detached from the garment (18) and placed on the table (21).

The user may then by hand gently ease the garment (18) more firmly over their knees.

Finally, by then carefully standing, using the table (21) for support, if necessary, the user may then pull the garment (18) easily and safely into its correct wearing position.

Conversely, when desiring to remove a garment (18) such as underpants, incontinence pants or elastic waisted tracksuit bottoms or trousers, the reverse sequence of the above would be followed.

The device may also be used as a pick up tool for retrieving garments from the floor.

The invention claimed is:

1. A system comprising:

two similar but independent hand held units designed to assist people with limited body flexibility to simply put on and take off underpants or elastic waisted trousers, each unit including a comfortable handle of various materials, connected to a strong, lightweight shaft, the shaft long enough so that when seated and holding the handle attached to the shaft at a first end, a second end of the shaft comfortably reaches the ground in front of a user's toes without excessive bending from the waist or hips, wherein, at the second end of each of the units' shafts is firmly attached a strong, but lightweight, slim, narrow profile curved head of elongate form and extending across the shaft, the curvature of the head being formed along the longitudinal axis of the head, the head having (i) an internal concave surface configured to guide the head along a leg of the user, and (ii) an opposing external convex surface being covered with a fabric gripping material, wherein each of the heads is designed to hold a weight of a garment comfortably and also hold a waistband of the garment open when correctly attached to the garment and the device is held in its correct working position.

2. The system as claimed in claim 1, wherein a first of the two units is designed to be used exclusively in the right hand of a user and as such has the letter R clearly stamped or moulded on an upper area of a concave surface of the head of the first of the two units, and wherein the other of the two units is designed to be used exclusively in the left hand of a user and as such has the letter L clearly stamped or moulded on an upper area of a concave surface of the head of the other of the two units.

3. The system as claimed in claim 2 wherein when each of the units is held in the correct position in a user's hands ready for use, the first of the two units in the right hand and the second of the two units in the left hand, with the stamped or moulded letters L & R in the upper section of the respective heads, the upper portion of said heads are angled towards the user's hand at a preset angle.

4. The system as claimed in claim 3, wherein the longitudinal axis of the head of each unit is set at a non-right angle to the attached shaft.

5. The system as claimed in claim 1, wherein each of the shafts connecting the respective handles and heads of each unit are of a light, but strong material.

6. The system as claimed in claim 1, wherein the units comprising the device are produced with handle, shaft and head integrally moulded or formed as a single piece for each unit.

7. The system as claimed in claim 1, wherein the handle, shaft and head are each produced separately of similar or widely different materials to each other.

8. The system claimed in claim 7, wherein the handle is produced from a soft, light, strong and waterproof material.

9. The system as claimed in claim 7, wherein the shaft is produced in a telescopic form having joints between each section of the telescopic shaft engineered in such a fashion as to enable the unit to be easily extended to its full length with a minimum of effort, but also easily compressed by simply holding the handle in one hand and gently tapping the head towards the handle with the palm of the other hand.

10. The system as claimed in claim 9, wherein the telescopic shaft in its compressed format is contained mainly within the attached handle.

11. The system as claimed in claim 9, further comprising a soft carry case adapted to hold the two telescopic units and an item of clothing.

12. The system as claimed in claim 1 wherein the shaft is produced separately from a light, but strong material.

13. The system as claimed in claim 1, wherein the units comprising the device are produced with the heads separately produced, each of the separately produced heads formed or moulded so as to include in its form a mounting block centrally on a concave surface of the head, a hole being moulded or drilled into the mounting block to allow for a separately produced shaft to be securely fitted to said head.

14. The system as claimed in claim 13, wherein the holes of the mounting block of the separately produced heads, have their centre line set at a preset angle to the longitudinal axis of each separately produced head, the hole in each separately produced head being marginally smaller in diameter than the diameter of the separately produced shaft to allow such shaft to fit snugly into said hole.

15. The system as claimed in claim 1, wherein each head unit has two tapered corners to assist with pulling on heavier garments.

16. The system as claimed in claim 15, wherein each head has on the two corners closest to the handle and extending onto the internal concave surface two small tapered triangular areas extending approx 7 mm along long and short edges of the head and sloping from the convex surface of the head, the base of this triangular area on the concave surface is approx 10 mm in length.

17. The system as claimed in claim 16, wherein the two tapered corners on each of the units' head provide an additional source of grip on the garment, particularly with heavier garments; wherein, in use the said tapered corners on each head are placed under the waistband of the garment being put on, so locating the head firmly in position to allow the heavier garment to be held securely by the device and pulled up as intended.

18. The system as claimed in claim 1 wherein each head has its entire convex (outside) surface covered by the fabric gripping material.

19. The system as claimed in claim 18 wherein the gripping material is connected to the convex surface of each head by a suitable adhesive, sufficiently strong to avoid separating from the head when the device is used as intended.

* * * * *